US011482171B2

(12) United States Patent
Chen et al.

(10) Patent No.: US 11,482,171 B2
(45) Date of Patent: Oct. 25, 2022

(54) DISPLAY PANEL, DISPLAY MODULE, AND DISPLAY DEVICE AND CONTROL METHOD THEREFOR

(71) Applicant: BOE TECHNOLOGY GROUP CO., LTD., Beijing (CN)

(72) Inventors: Yi Chen, Beijing (CN); Lirong Wang, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/298,228

(22) PCT Filed: Jul. 15, 2020

(86) PCT No.: PCT/CN2020/102024
§ 371 (c)(1),
(2) Date: May 28, 2021

(87) PCT Pub. No.: WO2021/008544
PCT Pub. Date: Jan. 21, 2021

(65) Prior Publication Data

US 2021/0375207 A1 Dec. 2, 2021

(30) Foreign Application Priority Data

Jul. 15, 2019 (CN) ..... 201910637330.4

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0426* (2013.01);
(Continued)

(58) Field of Classification Search
CPC ..... G09G 3/3233; G09G 3/3275; G09G 2300/0426; G09G 2300/0842;
(Continued)

(56) References Cited

U.S. PATENT DOCUMENTS

2010/0045655 A1 2/2010 Jang
2014/0292624 A1 10/2014 Choi et al.
(Continued)

FOREIGN PATENT DOCUMENTS

CN 105913801 8/2016
CN 106406622 2/2017
(Continued)

OTHER PUBLICATIONS

PCT International Search Report (w/ English translation) for corresponding PCT Application No. PCT/CN2020/102024, dated Sep. 29, 2020, 5 pages.
(Continued)

*Primary Examiner* — Amare Mengistu
*Assistant Examiner* — Jennifer L Zubajlo
(74) *Attorney, Agent, or Firm* — Dority & Manning, P.A.

(57) ABSTRACT

A display module includes a display panel, a source driving circuit, and a timing control circuit. The display panel includes a plurality of sub-pixels, at least one sense signal line, and at least one reference sense signal line. Each sub-pixel includes a pixel driving circuit including a driving transistor. The source driving circuit includes at least one analog-to-digital conversion sub-circuit. Two input terminals of an analog-to-digital conversion sub-circuit in the at least one analog-to-digital conversion sub-circuit are respectively coupled to at least one sense signal line and one reference sense signal line. The analog-to-digital conversion sub-circuit is configured to receive a sense voltage signal from the sense signal line and a reference voltage signal
(Continued)

from the reference sense signal line, to obtain a sensing digital signal in accordance with a voltage difference between the sense voltage signals and the reference voltage signal, and to output the sensing digital signal.

14 Claims, 7 Drawing Sheets

(52) U.S. Cl.
CPC . *G09G 2300/0842* (2013.01); *G09G 2310/08* (2013.01); *G09G 2320/0233* (2013.01); *G09G 2320/0295* (2013.01); *G09G 2330/02* (2013.01)

(58) Field of Classification Search
CPC ..... G09G 2310/08; G09G 2320/0233; G09G 2320/0295; G09G 2330/02
See application file for complete search history.

(56) References Cited

U.S. PATENT DOCUMENTS

| | | | | |
|---|---|---|---|---|
| 2015/0379909 | A1* | 12/2015 | Yu | G09G 3/006 345/78 |
| 2016/0189595 | A1 | 6/2016 | Choi et al. | |
| 2016/0253541 | A1 | 9/2016 | Yang et al. | |
| 2017/0154573 | A1* | 6/2017 | Woo | G09G 3/3233 |
| 2017/0352305 | A1 | 12/2017 | Chang et al. | |
| 2018/0061295 | A1 | 3/2018 | Hong | |
| 2018/0196543 | A1* | 7/2018 | Otagaki | G06F 3/0445 |
| 2020/0159385 | A1* | 5/2020 | Chung | G06F 3/0412 |
| 2020/0388220 | A1* | 12/2020 | Xu | G09G 3/3291 |
| 2021/0193044 | A1* | 6/2021 | Meng | G09G 3/3233 |

FOREIGN PATENT DOCUMENTS

| | | | | |
|---|---|---|---|---|
| CN | 106504707 | | 3/2017 | |
| CN | 106504707 | A * | 3/2017 | |
| CN | 108242229 | | 7/2018 | |
| CN | 108242229 | A * | 7/2018 | G09G 3/3611 |
| CN | 108346400 | | 7/2018 | |
| CN | 108346400 | A * | 7/2018 | G09G 3/3233 |
| CN | 110349542 | | 10/2019 | |

OTHER PUBLICATIONS

Chinese First Office Action (w/ English translation) for corresponding CN Application No. 201910637330.4, 21 pages.
Chinese Second Office Action (w/ English translation) for corresponding CN Application No. 201910637330.4, 18 pages.
Chinese Third Office Action (w/ English translation) for corresponding CN Application No. 201910637330.4, 15 pages.
Chinese Decision of Rejection (w/ English translation) for corresponding CN Application No. 201910637330.4, 16 pages.

* cited by examiner

DISPLAY PANEL, DISPLAY MODULE, AND DISPLAY DEVICE AND CONTROL METHOD THEREFOR

CROSS-REFERENCE TO RELATED APPLICATIONS

This application is a national phase entry under 35 USC 371 of International Patent Application No. PCT/CN 2020/102024, filed on Jul. 15, 2020, which claims priority to Chinese Patent Application No. 201910637330.4, filed on Jul. 15, 2019, which are incorporated herein by reference in their entirety.

TECHNICAL FIELD

The present disclosure relates to the field of display technologies, and in particular, to a display panel, a display module, and a display device and a control method therefor.

BACKGROUND

An organic light-emitting diode (OLED) display device has been widely used in various electronic devices including electronic products such as computers and mobile phones due to its advantages such as self-illumination, lightness and thinness, low power consumption, high contrast, high color gamut, and flexible display.

SUMMARY

A display module includes a display panel, a source driving circuit and a timing control circuit. The display panel includes a plurality of sub-pixels, at least one sense signal line and at least one reference sense signal line. Each sub-pixel includes a pixel driving circuit, and the pixel driving circuit includes a driving transistor. At least one of the plurality of sub-pixels is at least one selected sub-pixel. A pixel driving circuit in a selected sub-pixel in the at least one selected sub-pixel further includes a sense transistor, and the sense transistor in the selected sub-pixel is coupled to the driving transistor in the selected sub-pixel. The sense transistor in the selected sub-pixel is coupled to a sense signal line in the at least one sense signal line, and the sense signal line is configured to obtain a sense voltage signal of the driving transistor in the selected sub-pixel through the sense transistor. A reference sense signal line in the at least one reference sense signal line is configured to transmit a reference voltage signal.

The source driving circuit includes at least one analog-to-digital conversion sub-circuit. Two input terminals of an analog-to-digital conversion sub-circuit in the at least one analog-to-digital conversion sub-circuit are coupled to at least one sense signal line and one reference sense signal line, respectively. The analog-to-digital conversion sub-circuit is configured to receive the sense voltage signal from the sense signal line and the reference voltage signal from the reference sense signal line, to obtain a sensing digital signal in accordance with a voltage difference between the sense voltage signal and the reference voltage signal received at the two input terminals, and to output the sensing digital signal. The sensing digital signal is capable of representing an actual value of a compensation parameter of the driving transistor in the selected sub-pixel.

The timing control circuit is coupled to an output terminal of the analog-to-digital conversion sub-circuit. The timing control circuit is configured to receive the sensing digital signal from the source driving circuit, and to obtain compensation pixel data of the selected sub-pixel in accordance with the sensing digital signal and initial pixel data of the selected sub-pixel, so that the selected sub-pixel compensates for the compensation parameter of the driving transistor in the selected sub-pixel while being displayed in accordance with the compensation pixel data.

In some embodiments, the at least one reference sense signal line and the at least one sense signal line are arranged in parallel.

In some embodiments, the analog-to-digital conversion sub-circuit includes a differential analog-to-digital converter and a first switch. The differential analog-to-digital converter includes a first input terminal, a second input terminal and an output terminal. The first input terminal of the differential analog-to-digital converter is coupled to at least one sense signal line through the first switch, the second input terminal of the differential analog-to-digital converter is coupled to one reference sense signal line, and the output terminal of the differential analog-to-digital converter is coupled to the timing control circuit.

In some embodiments, the analog-to-digital conversion sub-circuit further includes a noise reduction capacitor. A first electrode of the noise reduction capacitor is coupled to the first input terminal of the differential analog-to-digital converter, and a second electrode of the noise reduction capacitor is coupled to a ground terminal.

In some embodiments, an extending direction of the at least one reference sense signal line is a first direction. The at least one reference sense signal line is disposed at at least one side of an active area of the display panel in a direction perpendicular to the first direction.

In some embodiments, the display panel includes one reference sense signal line. The reference sense signal line is located at any side of the active area of the display panel in the direction perpendicular to the first direction. The at least one analog-to-digital conversion sub-circuit is coupled to the reference sense signal line. Or, the display panel includes two reference sense signal lines. The two reference sense signal lines are located at two sides of the active area of the display panel in the direction perpendicular to the first direction. The source driving circuit includes at least two analog-to-digital conversion sub-circuits, some of the at least two analog-to-digital conversion sub-circuits are coupled to one reference sense signal line, and others of the at least two analog-to-digital conversion sub-circuits are coupled to another reference sense signal line.

In some embodiments, the display panel further includes a plurality of data lines, and each data line is coupled to pixel driving circuits in some of the plurality of sub-pixels. All sub-pixels included in the display panel are selected sub-pixels, and pixel driving circuits coupled to a same data line are coupled to a same sense signal line.

In some embodiments, the display panel further includes a plurality of data lines, and each data line is coupled to pixel driving circuits in some of the plurality of sub-pixels. All sub-pixels included in the display panel are selected sub-pixels, and pixel driving circuits coupled to a plurality of adjacent data lines that are arranged in sequence are coupled to a same sense signal line.

In some embodiments, in a case where the display panel includes at least two sense signal lines and the source driving circuit includes at least two analog-to-digital conversion sub-circuits, different analog-to-digital conversion sub-circuits are coupled to different sense signal lines.

In some embodiments, one analog-to-digital conversion sub-circuit is coupled to at least two sense signal lines.

In some embodiments, the display panel further includes a plurality of gate lines. In the pixel driving circuit in each selected sub-pixel, a control electrode of the sense transistor is coupled to one gate line, a first electrode of the sense transistor is coupled to a second electrode of the driving transistor, and a second electrode of the sense transistor is coupled to one sense signal line.

In some embodiments, the pixel driving circuit in the selected sub-pixel further includes a sensing capacitor. A first electrode of the sensing capacitor is coupled to one sense signal line, and a second electrode of the sensing capacitor is coupled to a ground terminal.

In some embodiments, the pixel driving circuit in each sub-pixel further includes a switching transistor and a storage capacitor. A control electrode of the switching transistor is coupled to one gate line, a first electrode of the switching transistor is coupled to one data line, and a second electrode of the switching transistor is coupled to a control electrode of the driving transistor. A first electrode of the storage capacitor is coupled to the control electrode of the driving transistor, and a second electrode of the storage capacitor is coupled to the second electrode of the driving transistor. A first electrode of the driving transistor is coupled to a first power supply voltage terminal. The second electrode of the driving transistor is further coupled to a first electrode of a light-emitting device. A second electrode of the light-emitting device is coupled to a second power voltage terminal.

In some embodiments, the light-emitting device is an organic light-emitting diode.

In another aspect, a display device is provided. The display device includes the display module as described in any of the above embodiments.

In yet another aspect, a display panel is provided. The display panel includes a plurality of sub-pixels, at least one sense signal line and at least one reference sense signal line. Each sub-pixel includes a pixel driving circuit, and the pixel driving circuit includes a driving transistor. At least one of the plurality of sub-pixels is at least one selected sub-pixel. A pixel driving circuit in a selected sub-pixel in the at least one selected sub-pixel further includes a sense transistor, and the sense transistor in the selected sub-pixel is coupled to the driving transistor in the selected sub-pixel. The sense transistor in the selected sub-pixel is coupled to a sense signal line in the at least one sense signal line, and the sense signal line is configured to obtain a sense voltage signal of the driving transistor in the selected sub-pixel through the sense transistor. A reference sense signal line in the at least one reference sense signal line is configured to transmit a reference voltage signal.

In yet another aspect, a control method of the display device as described above is provided. The control method includes a sense phase and a display phase.

In the sense phase, in at least one selected sub-pixel, the pixel driving circuit is turned on, and the sense signal line obtains the sense voltage signal of the driving transistor of the pixel driving circuit. The sense voltage signal is capable of representing the actual value of the compensation parameter of the driving transistor. The two input terminals of the analog-to-digital conversion sub-circuit in the source driving circuit receive the sense voltage signal from the sense signal line and the reference voltage signal from the reference sense signal line, respectively, and the analog-to-digital conversion sub-circuit obtains the sensing digital signal in accordance with the voltage difference between the sense voltage signal and the reference voltage signal received at the two input terminals, and outputs the sensing digital signal to the timing control circuit. The sensing digital signal is capable of representing the actual value of the compensation parameter of the driving transistor in the selected sub-pixel.

In the display phase, the timing control circuit receives the sensing digital signal from the source driving circuit, obtains the compensation pixel data of the selected sub-pixel in accordance with the sensing digital signal and the initial pixel data of the selected sub-pixel, so that the selected sub-pixel compensates for the compensation parameter of the driving transistor in the selected sub-pixel while being displayed in accordance with the compensation pixel data.

In some embodiments, the timing control circuit receiving the sensing digital signal from the source driving circuit, and obtaining the compensation pixel data of the selected sub-pixel in accordance with the sensing digital signal and the initial pixel data of the selected sub-pixel, includes: the timing control circuit obtaining a compensation amount of the compensation parameter of the driving transistor in a corresponding selected sub-pixel through calculation, conversion, and compensation, in accordance with the sensing digital signal and the initial pixel data of the corresponding selected sub-pixel, and generating the compensation pixel data of the corresponding selected sub-pixel in accordance with the compensation amount and the initial pixel data.

BRIEF DESCRIPTION OF THE DRAWINGS

In order to describe technical solutions in the present disclosure more clearly, the accompanying drawings to be used in some embodiments of the present disclosure will be introduced below briefly. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method, and an actual timing of a signal to which the embodiments of the present disclosure relate.

DETAILED DESCRIPTION

Figure 1:
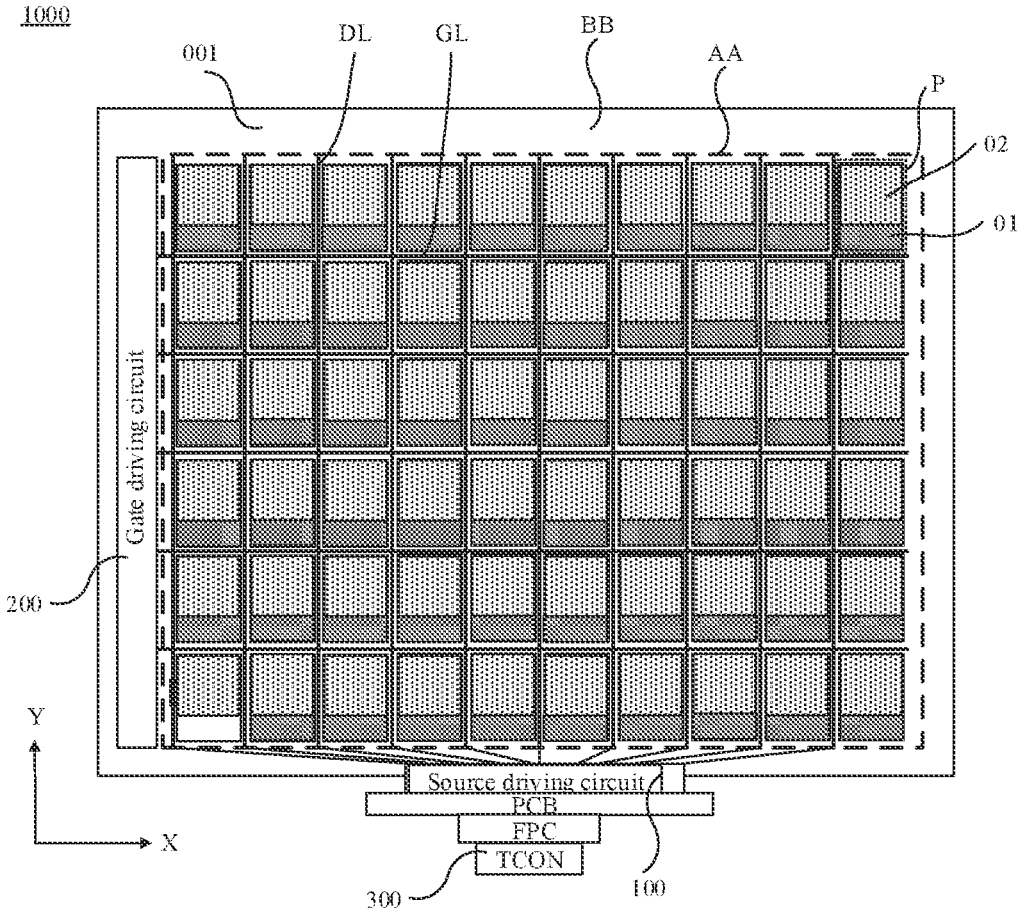
FIG. 1 is a structural diagram of a display module, in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art on a basis of the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to". In the description of the specification, terms such as "one embodiment", "some embodiments", "exemplary embodiments", "an example", "specific example" or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

Terms such as "first" and "second" are only used for descriptive purposes, and are not to be construed as indicating or implying the relative importance or implicitly indicating the number of indicated technical features below. Thus, a feature defined by "first" or "second" may explicitly or implicitly include one or more of the features. In the description of the embodiments of the present disclosure, "a plurality of/the plurality of" means two or more unless otherwise specified.

In the description of some embodiments, the terms such as "coupled" and "connected" and their extensions may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the content herein.

As used herein, the term if is, optionally, construed to mean "when" or "in a case where" or "in response to determining" or "in response to detecting", depending on the context. Similarly, the phrase "if it is determined" or "if [a stated condition or event] is detected" is, optionally, construed to mean "In a case where it is determined" or "in response to determining" or "in a case where [the stated condition or event] is determined" or "in response to detecting [the stated condition or event]", depending on the context.

The use of "applicable to" or "configured to" herein means an open and inclusive expression, which does not exclude devices that are applicable to or configured to perform additional tasks or steps.

In addition, the use of "based on" is meant to be open and inclusive, in that a process, step, calculation or other action "based on" one or more of the stated conditions or values may, in practice, be based on additional conditions or values beyond those stated.

In some embodiments of the present disclosure, a display device is provided. The display device may be a TV, a mobile phone, a computer, a notebook computer, a tablet computer, a personal digital assistant (PDA), or a vehicle-mounted computer, etc.

The display device in the embodiments of the present disclosure includes a display module, a rear shell, a frame, and the display module is disposed in a space enclosed by the rear shell and the frame.

In some embodiments, as shown in FIG. 1, the display module 1000 includes a display panel 001, a source driving circuit 100 (also referred to as a data driving circuit, a source drive IC, or a data drive IC), a gate driving circuit 200 and a timing control circuit (TCON) 300. The timing control circuit 300 is coupled to the source driving circuit 100 and the gate driving circuit 200, the source driving circuit 100 is coupled to the display panel 001, and the gate driving circuit 200 is coupled to the display panel 001 (the gate driving circuit may be disposed in the display panel 001). Under control of the timing control circuit 300, the source driving circuit 100 and the gate driving circuit 200, the display panel 001 realizes display.

The display device further includes a printed circuit board (PCB), a flexible printed circuit board (FPC) and other electronic accessories. Through the printed circuit board and the flexible printed circuit board, the display panel may be coupled to the source driving circuit and the gate driving circuit, and the source driving circuit may be coupled to the timing control circuit.

The display panel may be an organic light-emitting diode (OLED) display panel, a quantum dot light-emitting diode (QLED) display panel, a micro light-emitting diode (Micro LED) display panel, which is not specifically limited.

The embodiments of the present disclosure are described by taking an example in which the display panel is the OLED display panel.

As shown in FIG. 1, the display panel 001 includes an active area AA (also referred to as an effective display area) and a peripheral region BB arranged around the active area AA.

The display panel 001 includes a plurality of sub-pixels P, and the plurality of sub-pixels P are disposed in the active area AA. The plurality of sub-pixels P at least include sub-pixels of a first color, sub-pixels of a second color, and sub-pixels of a third color. The first, second and third colors are three primary colors (for example, red, green, and blue, respectively). For example, the display panel 001 may include red sub-pixels R, green sub-pixels G, and blue sub-pixels B. Or the display panel 001 may include red sub-pixels R, green sub-pixels G, blue sub-pixels B, and white sub-pixels W. In addition, the display panel 001 further includes a plurality of gate lines GL and a plurality of data lines DL, and the plurality of gate lines GL and the plurality of data lines DL are disposed in the active area AA of the display panel 001.

For convenience of description, the following description is made by taking an example in which the plurality of sub-pixels P are arranged in a matrix in the present disclosure. In this case, a column direction is regarded as a first direction Y, and a row direction is regarded as a second direction X. Sub-pixels P arranged in a row in the second direction X are referred to as sub-pixels in a same row, Sub-pixels P arranged in a column in the first direction Y are referred to as sub-pixels in a same column. The plurality of gate lines GL extend in the second direction X, and the plurality of data lines DL extend in the first direction Y.

Based on this, as shown in FIG. 1, pixel driving circuits 01 in a same row are coupled to a same gate line GL, and pixel driving circuits 01 in a same column are coupled to a same data line DL.

Each sub-pixel P includes a pixel driving circuit 01 and a light-emitting device 02. The pixel driving circuit 01 is coupled to the light-emitting device 02, and the pixel driving circuit 01 is configured to drive the light-emitting device 02 to emit light. The pixel driving circuit 01 includes a driving transistor DTFT. The light-emitting device 02 is, for example, an organic light-emitting diode (OLED).

A person skilled in the art will understand that, in addition to the driving transistor DTFT, the pixel driving circuit 01 may further include other transistors, capacitors and other devices, which is not specifically limited, and in practice, it may be set as needed.

Figure 2A:
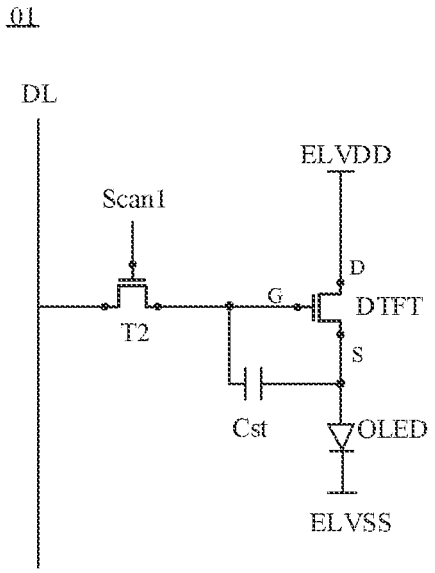
FIGS. 2A and 2B are structural diagrams of pixel driving circuits, in accordance with some embodiments of the present disclosure.

In some embodiments, structures of the pixel driving circuits 01 in the sub-pixels P are the same. In the embodiments of the present disclosure, the structure of the pixel driving circuit 01 is provided. As shown in FIG. 2A, the pixel driving circuit 01 includes the driving transistor DTFT, a switching transistor T2, and a storage capacitor Cst (i.e., a 2T1C structure). A control electrode of the switching transistor T2 is coupled to the gate line GL. For example, the control electrode of the switching transistor T2 is coupled to the gate line through a first scanning terminal Scan1. A first electrode of the switching transistor T2 is coupled to the data line DL, and a second electrode of the switching transistor T2 is coupled to a control electrode G of the driving transistor DTFT. A first electrode D of the driving transistor DTFT is coupled to a first power supply voltage terminal ELVDD. A first electrode of the storage capacitor Cst is coupled to the control electrode G of the driving transistor DTFT, and a second electrode of the storage capacitor Cst is coupled to a second electrode S of the driving transistor DTFT. The second electrode S of the driving transistor DTFT is further coupled to a first electrode of the light-emitting device (such as the organic light-emitting diode OLED), and a second electrode of the light-emitting device is coupled to a second power supply voltage terminal ELVSS.

A driving process of the pixel driving circuit 01 is that: the switching transistor T2 is turned on under control of the first scanning terminal Scan1, and transmits a data signal from the data line DL to the control electrode G of the driving transistor DTFT and the storage capacitor; and the storage capacitor Cst stores the data signal and discharges to the driving transistor DTFT, and thus the driving transistor DTFT generates a driving current under an action of a voltage of the control electrode thereof, and transmits the driving current to the light-emitting diode OLED, so as to make the light-emitting diode OLED emit light. A magnitude of the driving current is related to a voltage of the data signal input to the sub-pixel.

In the display panel 001, due to effects of factors such as process conditions and driving environments, threshold voltages or mobilities of the driving transistors of the pixel driving circuits 01 included in the sub-pixels P are different. As a result, the driving currents generated by the driving transistors in the sub-pixels are not exactly the same under a drive of a same data signal, which results in brightness deviations of the sub-pixels and thus reduces the quality of display images.

In some embodiments, by extracting (sensing) electrical characteristics of the driving transistor, and by using an external compensation to compensate for the threshold voltage, the mobility or other parameters of the driving transistor, the quality of the display images may be improved. The electrical characteristics of the driving transistor include an I-V characteristic of the driving transistor, and the I-V characteristic of the driving transistor is related to the threshold voltage and the mobility thereof.

The parameter such as the threshold voltage or the mobility of the driving transistor is referred to as a compensation parameter of the driving transistor. Ideally, the parameters such as the threshold voltages or the mobilities of the driving transistors DTFT in the sub-pixels P should be the same. That is, the compensation parameter has an ideal value. Due to the differences of the process factors and the driving environments, the threshold voltages or the mobilities of the driving transistors have non-uniformity, so that a deviation between an actual value of the compensation parameter and the ideal value of the compensation parameter in each transistor is present. Therefore, it is necessary to compensate for the compensation parameter of the driving transistor.

Figure 3A:
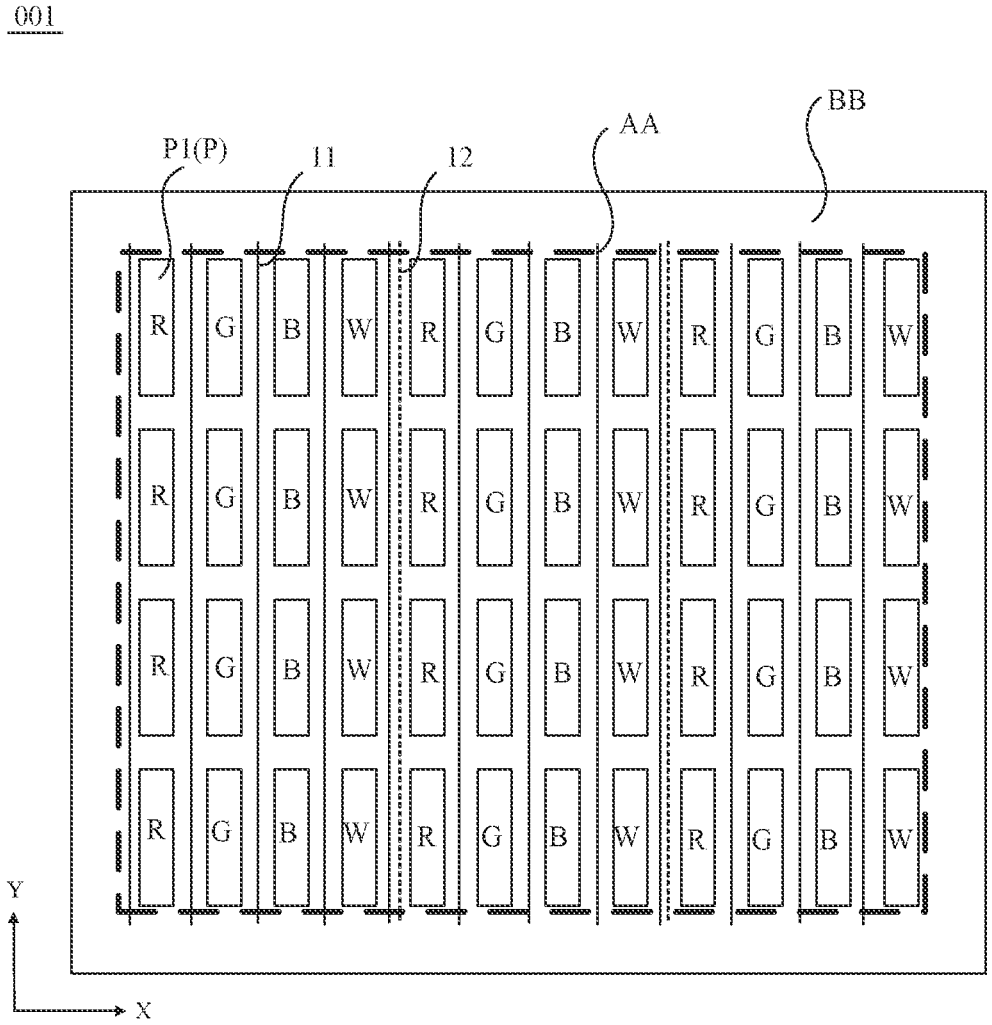
FIG. 3A is a structural diagram of a display panel, in accordance with some embodiments of the present disclosure.
Figure 3B:
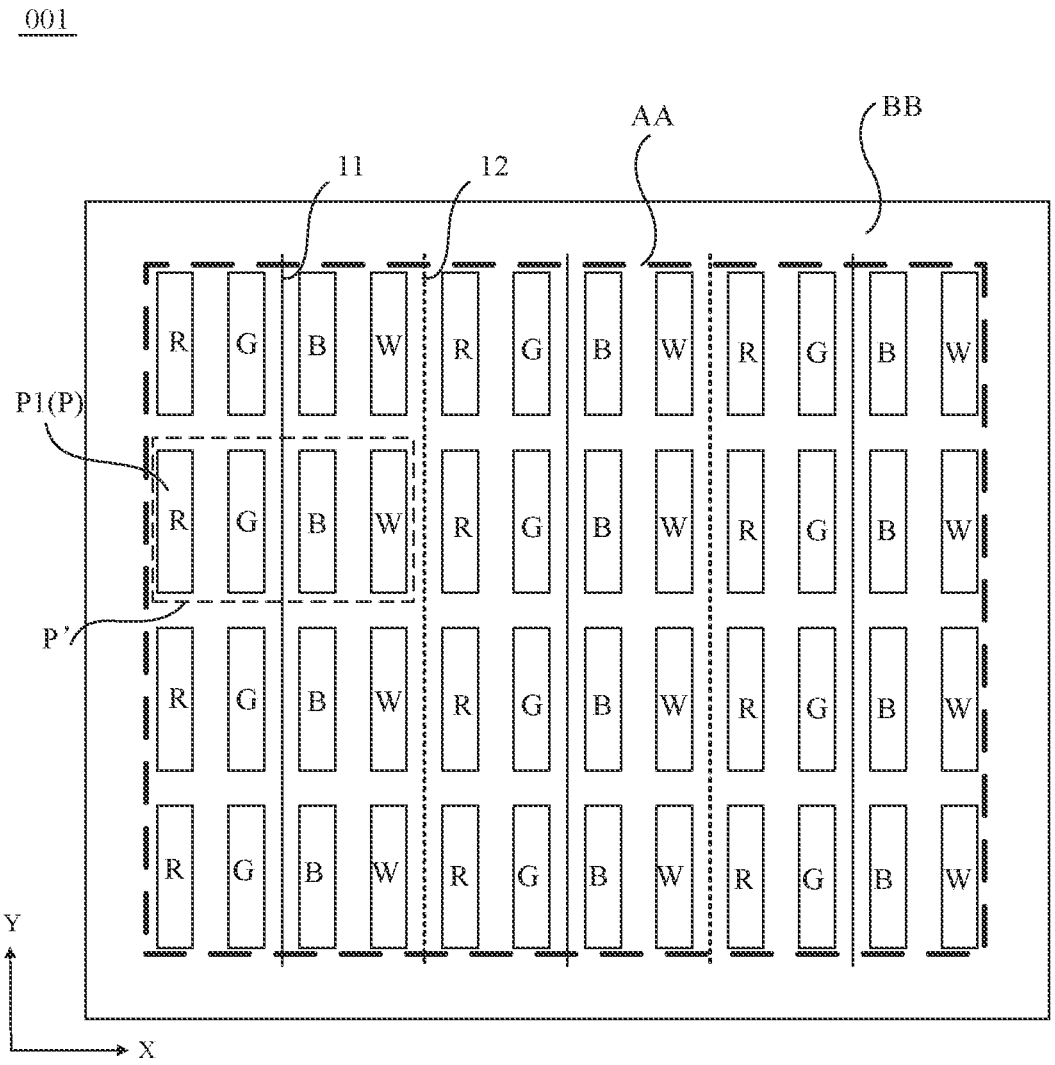
FIG. 3B is another structural diagram of a display panel, in accordance with some embodiments of the present disclosure.

Base on this, as shown in FIGS. 3A and 3B, the display panel 001 further includes at least one sense signal line (also referred to as sense line) 11 and at least one reference sense signal line (also referred to as reference sense line) 12. At least one of the plurality of sub-pixels P is selected sub-pixel(s) P1, and each selected sub-pixel P1 further includes a sense transistor T1. In the selected sub-pixel P1, the sense transistor T1 is coupled to the driving transistor DTFT and one sense signal line 11.

The sense signal line 11 is configured to obtain a sense voltage signal of the driving transistor DTFT in the selected sub-pixel P1 through the sense transistor T1. For example, in a sense phase, in a case where the driving transistor DTFT generates the driving current and the sense transistor T1 is turned on, the sense transistor T1 extracts the driving current to the sense signal line 11, so that the sense transistor T1 obtains the sense voltage signal of the driving transistor DTFT. The sense voltage signal is related to the driving current of the driving transistor DTFT, and the driving current of the driving transistor DTFT is related to the actual value of the compensation parameter of the driving transistor. Therefore, the sense voltage signal is related to the actual value of the compensation parameter, and is able to represent the actual value of the compensation parameter of the driving transistor.

The at least one reference sense signal line 12 is configured to transmit a reference voltage signal. In some embodiments, during a working process of the display device, the reference sense signal line 12 is configured to always transmit the reference voltage signal.

In some embodiments, the at least one sense signal line 11 and the at least one reference sense signal line 12 are arranged in parallel or substantially in parallel.

Figure 2B:
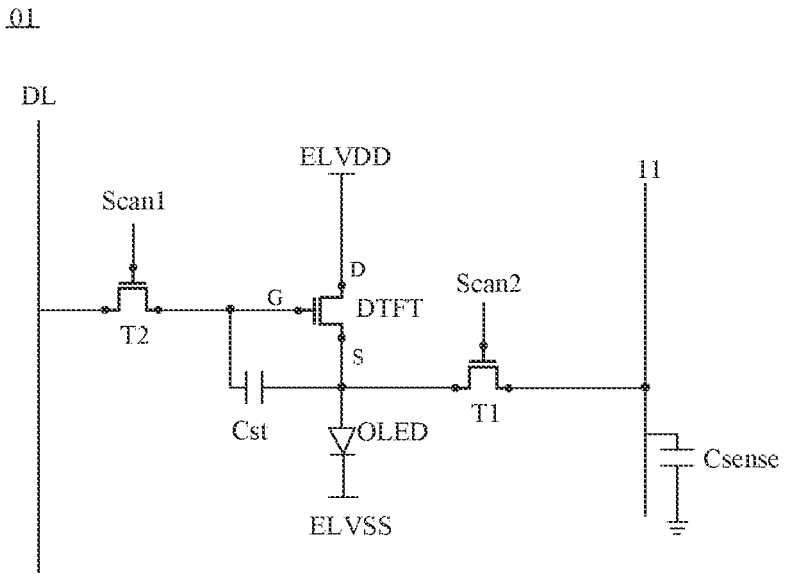

As shown in FIG. 2B, for example, in the pixel driving circuit 01 in the selected sub-pixel P1, a control electrode of the sense transistor T1 is coupled to a gate line (the gate line GL). For example, the control electrode of the sense transistor T1 is coupled to the date line through a second scanning terminal Scan2, a first electrode of the sense transistor T1 is coupled to the second electrode of the driving transistor DTFT, and a second electrode of the sense transistor T1 is coupled to the sense signal line 11.

In some embodiments, as shown in FIG. 2B, the pixel driving circuit 01 in the selected sub-pixel P1 further includes a sensing capacitor Csense. A first electrode of the sensing capacitor Csense is coupled to the sense signal line 11, and a second electrode of the sensing capacitor Csense is coupled to a ground terminal.

It will be noted that, in the selected sub-pixel P1, the gate line coupled to the sense transistor T1 and the gate line coupled to the switching transistor T2 are a same gate line. In the sense phase, the sense transistor T1 and the switching transistor T2 are turned on or off synchronously under control of a scan signal from the gate line. Or, the gate line coupled to the sense transistor T1 and the gate line coupled to the switching transistor T2 are two adjacent gate lines. In the sense phase, the two adjacent gate lines may transmit a same scan signal, thereby controlling the sense transistor T1 and the switching transistor T2 to be turned on or off synchronously.

It will be noted that the transistors may be enhancement transistors, or depletion transistors. The transistors may also be of N-type or of P-type. The first electrode of the transistor may be a source, and the second electrode may be a drain, or the first electrode of the transistor may be the drain, and the second electrode may be the source, which is not limited, and in practice, may be selected and set as needed.

The following embodiments are described by taking an example in which the sub-pixels P included in the display panel 001 are the selected sub-pixels P1. That is, the pixel driving circuit 01 in each sub-pixel P further includes the sense transistor T1, and the pixel driving circuit 01 in each sub-pixel P adopts the pixel driving circuit 01 shown in FIG. 2B.

As shown in FIG. 1 and FIGS. 3A to 4B, the source driving circuit 100 includes at least one analog-to-digital conversion sub-circuit 101. Two input terminals of one analog-to-digital conversion sub-circuit 101 are respectively coupled to at least one sense signal line 11 and one reference sense signal line 12, and an output terminal of the analog-to-digital conversion sub-circuit 101 is coupled to the timing control circuit 300. For example, as shown in FIG. 4A, the two input terminals of the analog-to-digital conversion sub-circuit 101 are coupled to one sense signal line 11 and one reference sense signal line 12, respectively.

The analog-to-digital conversion sub-circuit 101 is configured to receive the sense voltage signal from the sense signal line 11 and the reference voltage signal from the reference sense signal line 12, and to obtain a sensing digital signal in accordance with a voltage difference of the signals received at the two input terminals, and to output the sensing digital signal to the timing control circuit 300. The sensing digital signal is able to represent the actual value of the compensation parameter of the driving transistor DTFT in the selected sub-pixel. In some embodiments, the sensing digital signal may be a binary digital signal.

It will be noted that, as described above, the parameter such as the threshold voltage or the mobility of the driving transistor is referred to as the compensation parameter. The sensing digital signal is able to represent the actual value of the compensation parameter of the driving transistor in the selected sub-pixel, which means that the sensing digital signal and the actual value of the compensation parameter of the driving transistor DTFT have a one-to-one mapping relationship therebetween. Since the sense voltage signal obtained by the sense signal line 11 is related to the actual value of the compensation parameter of the driving transistor DTFT, and is able to represent the actual value of the compensation parameter of the driving transistor, and the sensing digital signal is obtained from the sense voltage signal and the reference voltage signal, the sensing digital signal is related to the actual value of the compensation parameter of the driving transistor. That is, when the actual value of the compensation parameter of the driving transistor DTFT changes, the sensing digital signal obtained by the analog-to-digital conversion sub-circuit 101 also changes. Therefore, the actual value of the compensation parameter of the driving transistor DTFT may be obtained through a back-calculation in a subsequent calculation.

The two input terminals of the analog-to-digital conversion sub-circuit 101 are respectively coupled to at least one sense signal line 11 and one reference sense signal line 12, which means that the two input terminals of the analog-to-digital conversion sub-circuit 101 may be respectively coupled to one sense signal line 11 and one reference sense signal line 12, or the two input terminals of the analog-to-digital conversion sub-circuit 101 may be respectively coupled to a plurality of sense signal lines 11 and one reference sense signal line 12. That is, one input terminal of the analog-to-digital conversion sub-circuit 101 is only coupled to one reference sense signal line 12, and another input terminal may be coupled to one or more sense signal lines 11. In a case where the analog-to-digital conversion sub-circuit 101 is coupled to the plurality of sense signal lines 11, the plurality of sense signal lines 11 may be driven in a time-sharing manner, so that the analog-to-digital conversion sub-circuit 101 only receives the sense voltage signal from one sense signal line 11 and the reference voltage signal from one reference sense signal line 12 at a time, and processes the signals.

As shown in FIG. 1, the timing control circuit 300 is configured to: receive the sensing digital signal from the source driving circuit 100; and in accordance with the sensing digital signal and initial pixel data corresponding to a same selected sub-pixel P1, obtain compensation pixel data of the selected sub-pixel P1, so that the selected sub-pixel P1 compensates for the compensation parameter of the driving transistor in the selected sub-pixel while being displayed in accordance with the compensation pixel data. The initial pixel data are set pixel data of the selected sub-pixel input from the outside, and the set pixel data are set before the display device leaves the factory.

A compensation parameter of a driving transistor is compensated by extracting (sensing) electrical characteristics of the driving transistor, and by using an external compensation, which means that a source driving circuit directly obtains an actual value of the compensation parameter of the driving transistor from a sense voltage signal input from a sense signal line, thereby compensating for the compensation parameter of the driving transistor in accordance with the obtained actual value of the compensation parameter of the driving transistor and an ideal value of the compensation parameter. For example, one input terminal of an analog-to-digital conversion sub-circuit in the source driving circuit is coupled to at least one sense signal line (i.e., single terminal input), an output terminal of the analog-to-digital conversion sub-circuit is coupled to a timing control circuit, and the analog-to-digital conversion sub-circuit obtains the actual value of the compensation parameter of the driving transistor from the sense voltage signal received from the sense signal line.

However, in an actual process of sensing the electrical characteristics of the driving transistor, the electrical characteristics are inevitably affected by the parasitic effect of the capacitance inside the display panel and the noise of the circuit system. For example, the sense voltage signal input from the sense signal line is affected by the parasitic effect of the capacitance inside the display panel and the noise of the circuit system, which results in a deviation itself. As a result, the extracted actual value of the compensation parameter of the driving transistor is inaccurate, and has a deviation, which further results in a poor compensation effect, so that the effect of improving the image quality is not obvious.

In contrast, the display panel 001 is provided with the at least one sense signal line 11 and the at least one reference sense signal line 12. The analog-to-digital conversion sub-circuit 101 in the source driving circuit 100 obtains the sensing digital signal in accordance with the voltage difference between the sense voltage signal from the sense signal line 11 and the reference voltage signal from the reference sense signal line 12, and outputs the sensing digital signal to the timing control circuit 300, so that the timing control circuit 300 obtains the actual value of the compensation parameter of the driving transistor DTFT. Since the sense signal line 11 and the reference sense signal line 12 are substantially uniformly affected by the parasitic effect of the capacitance inside the display panel 001 and the noise of the circuit system, and the two are more uniformly affected by the noise of the system in a case where the sense signal line 11 and the reference sense signal line 12 are arranged in parallel or substantially in parallel in the display panel 001, when the analog-to-digital conversion sub-circuit 101 obtains the sensing digital signal in accordance with the voltage difference between the sense voltage signal from the sense signal line 11 and the reference voltage signal from the reference sense signal line 12, the effects on the sense signal line(s) 11 and the reference sense signal line(s) 12 may be offset, and the common mode noise may be eliminated. That is, the parasitic effect of the capacitance inside the display panel 001 and the effect of the noise of the circuit system are eliminated, thereby improving an accuracy of the acquired actual value of the compensation parameter of the driving transistor DTFT (i.e., improving an sensing accuracy), and improving a compensation accuracy, so that the image quality is significantly improved.

Figure 4A:
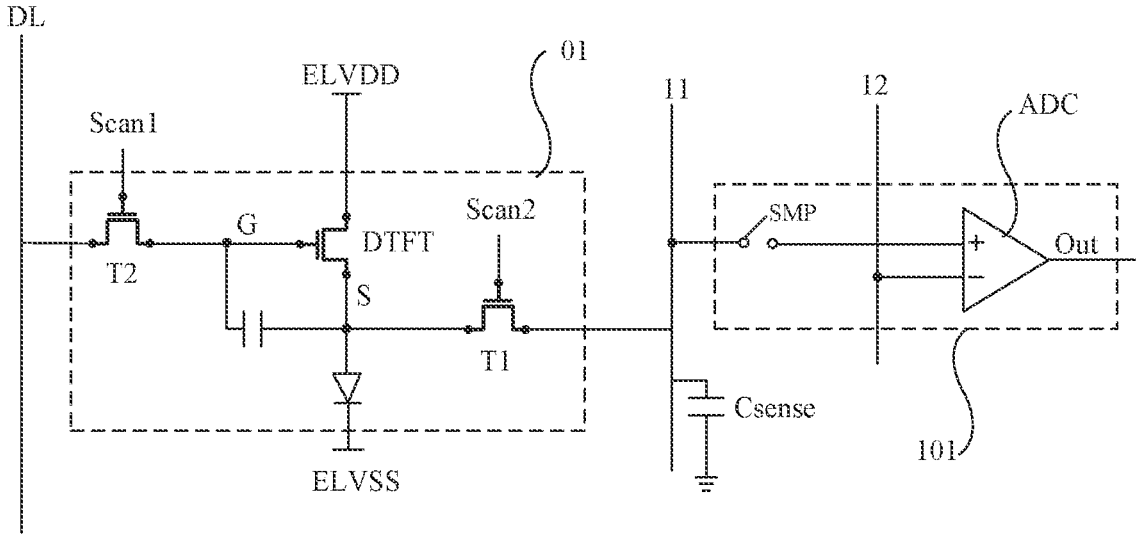
FIG. 4A is a structural diagram of a pixel driving circuit and an analog-to-digital conversion sub-circuit, in accordance with some embodiments of the present disclosure.
Figure 4B:
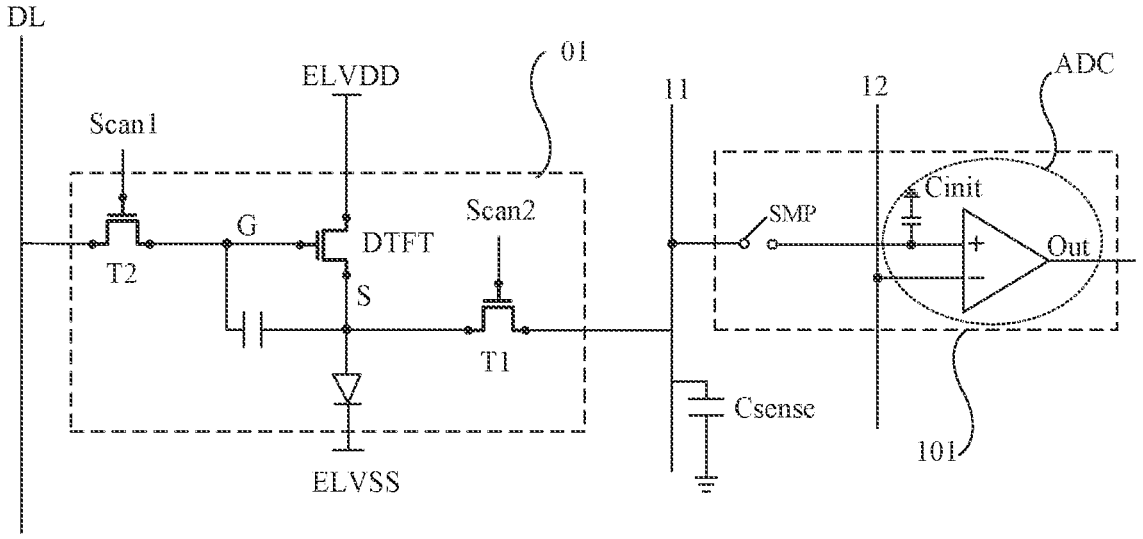
FIG. 4B is another structural diagram of a pixel driving circuit and an analog-to-digital conversion sub-circuit, in accordance with some embodiments of the present disclosure.

In some embodiments, as shown in FIGS. 4A and 4B, the analog-to-digital conversion sub-circuit 101 includes a differential analog-to-digital converter (ADC) (i.e., analog-to-digital converter with double terminals) and a first switch SMP.

As shown in FIG. 4A, the differential analog-to-digital converter (ADC) includes a first input terminal, a second input terminal and an output terminal.

The first input terminal (also referred to as a positive input terminal) of the differential analog-to-digital converter (ADC) is coupled to the sense signal line 11 through the first switch SMP, the second input terminal (also referred to as an inverting input terminal) of the differential analog-to-digital converter (ADC) is coupled to the reference sense signal line 12, and the output terminal Out of the differential analog-to-digital converter (ADC) is coupled to the timing control circuit (TCON).

After an actual simulation comparison, it is known that, an analog image of a sensing digital signal obtained through an analog-to-digital converter with a single input terminal in the prior art has obvious horizontal stripes, which indicates that the sensing digital signal generates an obvious noise. An analog image of the sensing digital signal obtained through the differential analog-to-digital converter with the double terminals has no horizontal stripes. That is, the noise of the sensing digital signal obtained by using the differential analog-to-digital converter is reduced, and the sensing digital signal is more accurate.

In some embodiments, as shown in FIG. 4B, a noise reduction capacitor Cinit is further provided in the differential analog-to-digital converter (ADC), so as to reduce the noise inside the differential analog-to-digital converter (ADC) through the noise reduction capacitor Cinit. A first electrode of the noise reduction capacitor Cinit is coupled to the first input terminal of the differential analog-to-digital converter (ADC), and a second electrode of the noise reduction capacitor Cinit is coupled to the ground terminal.

The specific settings of the sense signal line(s) 11, the reference sense signal line(s) 12, and the source driving circuit 100 in the display panel 001 will be further described in the following embodiments. The following description is made by taking an example in which the plurality of sub-pixels P included in the display panel 001 are arranged in an array, and the plurality of sub-pixels P are the selected sub-pixels P1.

For the at least one sense signal line 11:

as shown in FIG. 1, the plurality of data lines DL extend in the first direction Y. In some embodiments, as shown in FIGS. 3A and 3B, the at least one sense signal line 11 is arranged parallel to the plurality of data lines DL. That is, the at least one sense signal line 11 extends in the first direction Y.

In some embodiments, each data line DL is coupled to the pixel driving circuits in some of the plurality of sub-pixels P, and the pixel driving circuits 01 coupled to a same data line DL are coupled to a same sense signal line 11.

For example, as shown in FIG. 3A, the pixel driving circuits 01 in the sub-pixels P in the same column are coupled to a same data line DL. In this case, the pixel driving circuits 01 in the sub-pixels P in the same column are coupled to a same sense signal line 11. That is, the sense transistors T1 of the pixel driving circuits 01 in the sub-pixels P in the same column are coupled to the same sense signal line 11. That is, the number of the data lines DL is equal to the number of columns of the plurality of sub-pixels P, and the number of the sense signal lines 11 is equal to the number of the columns of the plurality of sub-pixels P.

In some other embodiments, the pixel driving circuits 01 coupled to a plurality of adjacent data lines DL that are arranged in sequence are coupled to a same sense signal line 11.

For example, the plurality of sub-pixels P are arranged in the array, the pixel driving circuits 01 coupled to the plurality of adjacent data lines DL that are arranged in sequence are pixel driving circuits 01 in a plurality of adjacent columns of sub-pixels P, and the pixel driving circuits 01 in the plurality of adjacent columns of sub-pixels P are coupled to a same sense signal line 11.

For example, as shown in FIG. 3B, the display panel includes the red sub-pixels R, the green sub-pixels G, the blue sub-pixels B, and the white sub-pixels W. The plurality of sub-pixels P are arranged in the array, and each column of sub-pixels P are sub-pixels of a same color. The plurality of columns of sub-pixels P are arranged in an order of RGBW. For example, a first column of sub-pixels P are all red sub-pixels R, a second column of sub-pixels P are all green sub-pixels G, and so on. Each adjacent four columns of sub-pixels (RGBW) are divided into one group, and four adjacent sub-pixels in a same row form a pixel P'. The pixel driving circuits included in the four columns of sub-pixels (RGBW) in each group are coupled in one-to-one correspondence with four adjacent data lines DL that are arranged in sequence (the data lines DL are not shown in FIG. 3B, which may refer to FIG. 1). Moreover, the pixel driving circuits 01 included in the four columns of sub-pixels (RGBW) may be coupled to a same sense signal line 11 (the connection relationship is not shown in FIG. 3B), By coupling the pixel driving circuits 01 in the plurality of adjacent columns of sub-pixels P to the same sense signal line 11, the number of the sense signal lines 11 may be reduced, thereby preventing an excessive number of the sense signal lines 11 from affecting the active area AA.

For example, in this case, in some embodiments, as shown in FIG. 3B, the sense signal line(s) 11 may be disposed in a middle region of the four adjacent columns of sub-pixels (RGBW), i.e., a position between the green sub-pixels G and the blue sub-pixels B. In this way, distances of four sub-pixels in one pixel from the sense signal line 11 may be uniform. Or, the sense signal line 11 may also be disposed at any side of the four adjacent columns of sub-pixels (RGBW).

For the at least one reference sense signal line 12:

as described above, the at least one reference sense signal line 12 may be arranged parallel to at least one sense signal line 11. That is, extending directions of the at least one reference sense signal line 12 and the at least one sense signal line 11 are the same. In some embodiments, the extending directions of the at least one sense signal line 11 and the plurality of data lines DL are the same. In this case, the extending directions of the at least one reference sense signal line 12 and the plurality of data lines DL are also the same, so that the at least one reference sense signal line 12, the at least one sense signal line 11, and the plurality of data lines DL all extend in the first direction Y.

In some embodiments, as shown in FIGS. 3A and 3B, both the at least one reference sense signal line 12 and the at least one sense signal line 11 are disposed in the active area AA of the display panel 001. In this way, the effects of the parasitic effect of the capacitance inside the display panel 001 and the noise of the circuit system on the reference sense signal line(s) 12 and the sense signal line(s) 11 may be as uniform as possible. Therefore, when the analog-to-digital conversion sub-circuit 101 obtains the sensing digital signal in accordance with the voltage difference between the sense voltage signal from the sense signal line 11 and the reference voltage signal from the reference sense signal line 12, the noise may be eliminated as much as possible, and thus the compensation accuracy may be improved.

Figure 5:
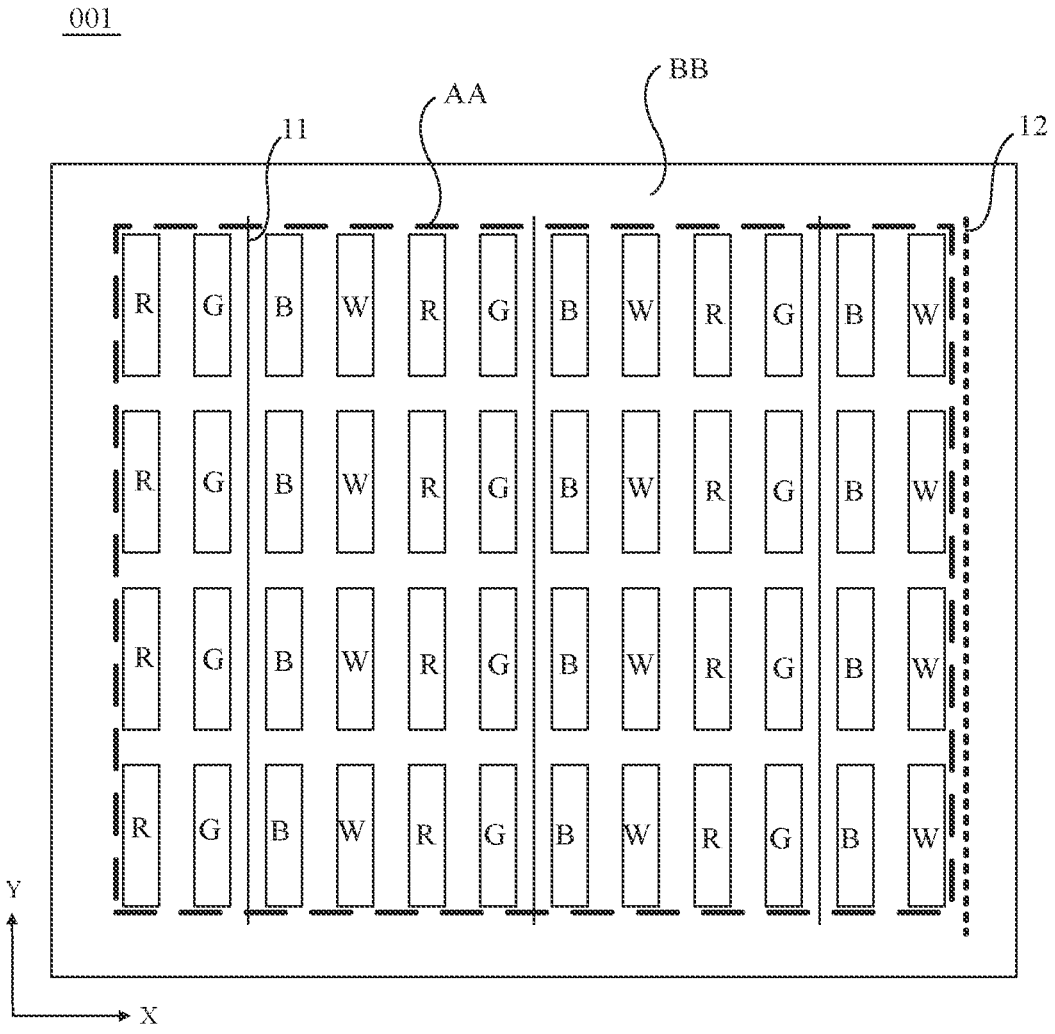
FIG. 5 is yet another structural diagram of a display panel, in accordance with some embodiments of the present disclosure.
Figure 6:
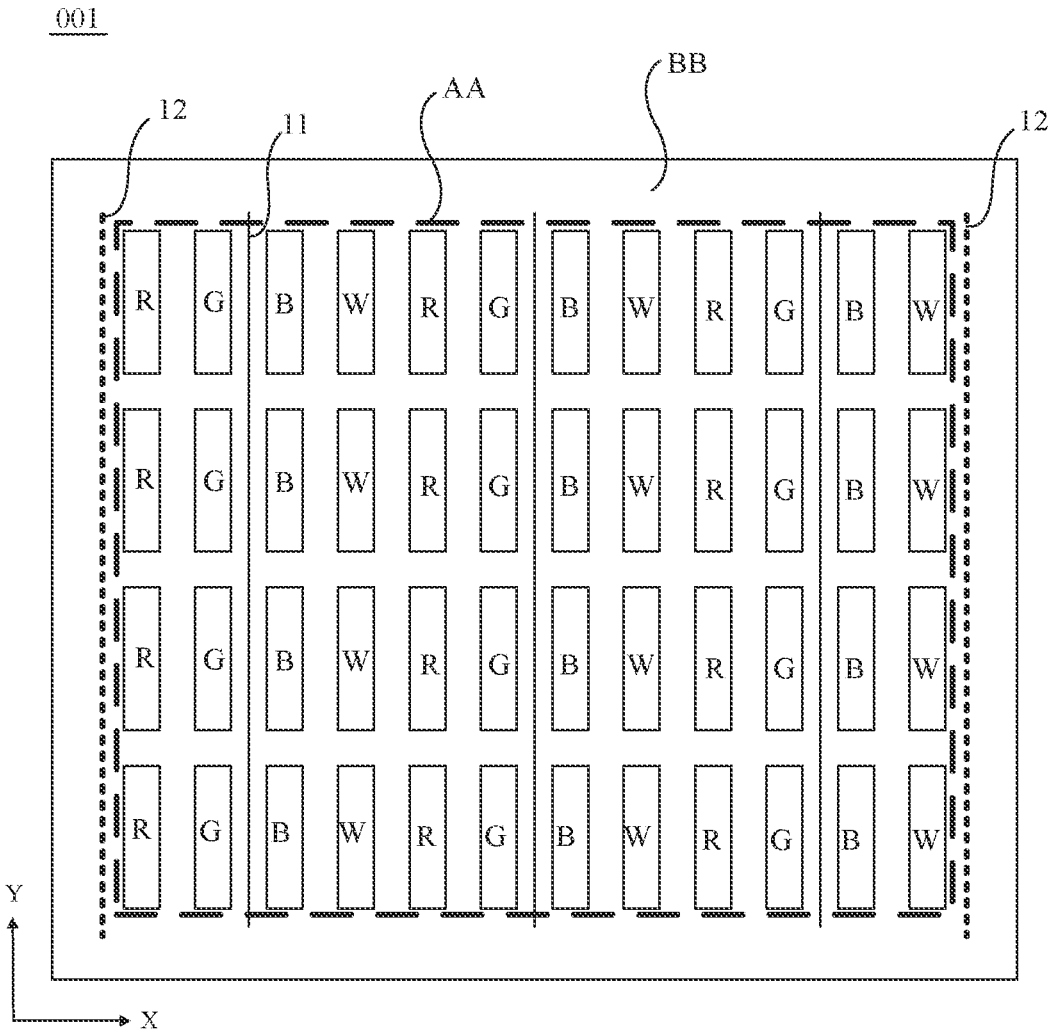
FIG. 6 is yet another structural diagram of a display panel, in accordance with some embodiments of the present disclosure.

In some other embodiments, as shown in FIGS. 5 and 6, the at least one reference sense signal line 12 may be disposed in the peripheral region BB. For example, the at least one reference sense signal line 12 is located at at least one side of the active area AA in a direction perpendicular to the first direction Y (i.e., the extending direction of the data lines DL or the at least one reference sense signal line 12), so as to prevent the at least one reference sense signal line 12 from affecting the active area AA. Of course, in this case, the reference sense signal line may also be referred to as a dummy reference signal line/virtual reference signal line.

In some examples, as shown in FIG. 5, the display panel 001 includes one reference sense signal line 12. The reference sense signal line 12 is located at any side of the active area AA of the display panel 001 in the direction perpendicular to the first direction Y. For example, the reference sense signal line 12 is located at a right side of the active area of the display panel 001. In a case where the source driving circuit 100 includes one analog-to-digital conversion sub-circuit 101, the analog-to-digital conversion sub-circuit 101 is coupled to the reference sense signal line 12. In a case where the source driving circuit 100 includes a plurality of analog-to-digital conversion sub-circuits 101, the analog-to-digital conversion sub-circuits 101 are coupled to the reference sense signal line 12. That is, one reference sense signal line 12 is coupled to a plurality of analog-to-digital conversion sub-circuits 101, and the plurality of analog-to-digital conversion sub-circuits 101 share one reference sense signal line 12.

In some other examples, as shown in FIG. 6, the display panel 001 includes two reference sense signal lines 12, and the two reference sense signal lines 12 are located at two sides of the active area AA of the display panel 001 in the direction perpendicular to the first direction Y. For example, the two reference sense signal lines 12 are respectively located at a left side and the right side of the active area AA of the display panel 001. In this case, the source driving circuit 100 includes at least two analog-to-digital conversion sub-circuits 101. Some of the at least two analog-to-digital conversion sub-circuits 101 are coupled to one reference sense signal line 12, and others of the at least two analog-to-digital conversion sub-circuits 101 are coupled to another reference sense signal line 12.

In some embodiments, the reference sense signal lines 12 may be disposed in the active area AA and in the peripheral region BB. The reference sense signal line(s) 12 are located at at least one side of the active area AA in the direction perpendicular to the first direction.

For the source driving circuit 100:

In some embodiments, the source driving circuit 100 includes one analog-to-digital conversion sub-circuit 101. In this case, the display panel 001 includes at least one sense signal line 11 and one reference sense signal line 12. The analog-to-digital conversion sub-circuit 101 is coupled to the at least one sense signal line 11 and the reference sense signal line 12. In a case where there are a plurality of sense signal lines 11, the plurality of sense signal lines 11 sense the selected sub-pixels coupled thereto in the time-sharing manner, so that the analog-to-digital conversion sub-circuit 101 senses the actual value of the compensation parameter of the driving transistor in one selected sub-pixel in a same period.

In some other embodiments, the source driving circuit 100 includes a plurality of analog-to-digital conversion sub-circuits 101. In this case, the display panel 001 includes a plurality of sense signal lines 11 and at least one reference sense signal line 12.

Different analog-to-digital conversion sub-circuits 101 are coupled to different sense signal lines 11.

For example, in a case where the number of the analog-to-digital conversion sub-circuits 101 and the number of the sense signal lines 11 are the same, one analog-to-digital conversion sub-circuit 101 is coupled to one sense signal line 11, and different analog-to-digital conversion sub-circuits 101 are coupled to different sense signal lines 11. In a case where the number of the analog-to-digital conversion sub-circuits 101 is less than the number of the sense signal lines 11, one analog-to-digital conversion sub-circuit 101 is coupled to at least one sense signal line 11, and one sense signal line 11 is not coupled to a plurality of analog-to-digital conversion sub-circuits 101.

As described above, different analog-to-digital conversion sub-circuits 101 may be coupled to a same reference sense signal line 12, or may be coupled to different reference sense signal lines 12, which is not limited.

Figure 7:
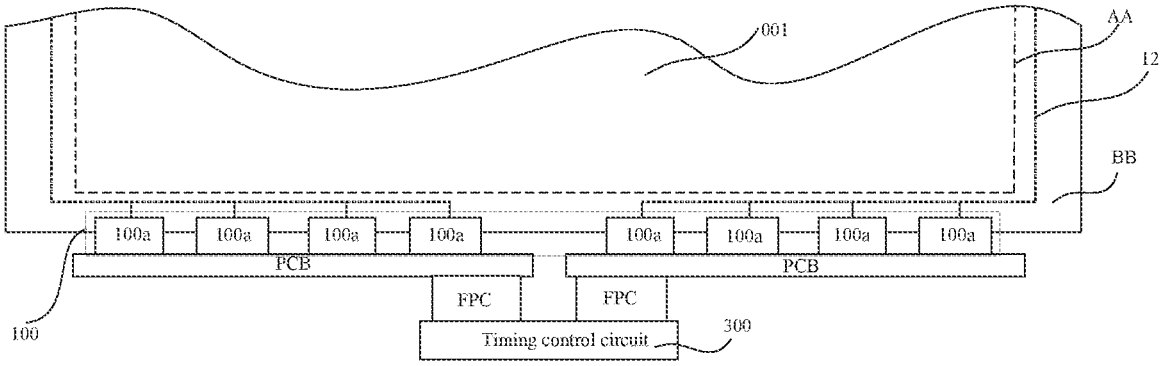
FIG. 7 is a partial diagram of a display module, in accordance with some embodiments of the present disclosure.

In addition, as shown in FIG. 7 (FIG. 7 is a partial diagram of the display module 001), in some embodiments, the source driving circuit 100 includes at least one source driver 100*a*, which may be understood that the display device includes at least one source driver 100*a*. The at least one source driver 100*a* is collectively referred to as the source driving circuit 100. The at least one analog-to-digital conversion sub-circuit 101 included in the source driving circuit 100 is disposed in the at least one source driver 100*a*, and one or more analog-to-digital conversion sub-circuits 101 may be disposed in one source driver 100*a*.

For example, the source driving circuit 100 includes eight source drivers 100*a*, and each source driver 100*a* is provided with one analog-to-digital conversion sub-circuit 101. Data signals are supplied to the data lines DL through the eight source drivers 100*a*. The actual value of the compensation parameter of the driving transistor DTFT of the pixel driving circuit 01 in the selected sub-pixel P1 is sensed through the eight analog-to-digital conversion sub-circuits 101 when the plurality of sub-pixels P are controlled to reach corresponding gray scales.

As shown in FIG. 7, in some examples, the eight source drivers 100*a* are divided into two groups, Each group of source drivers 100*a* includes four source drivers 100*a*. Two groups of source drivers 100*a* are electrically connected to the timing control circuit 300 through different PCBs and FPCs, respectively.

On this basis, in some embodiments, the source driving circuit 100 may adopt an encapsulation of COF (chip on flex, often called as chip on film).

In some embodiments, in a case where the at least one reference sense signal line 12 is disposed in the active area AA of the display panel 001, one reference sense signal line 12 is disposed at a position corresponding to each source driver 100*a*. For example, a total of eight reference sense signal lines 12 are disposed in the active area AA of the display panel 001, and each reference sense signal line 12 is coupled to a plurality of analog-to-digital conversion sub-circuits 101 in the source driver 100*a* corresponding to the reference sense signal line 12.

In some other embodiments, as shown in FIG. 7, in a case where the at least one reference sense signal line 12 is disposed in the peripheral region BB of the display panel 001, two reference sense signal lines 12 are respectively disposed at the two sides, in the direction perpendicular to the extending direction of the reference sense signal line (i.e., the first direction Y), of the active area AA in the peripheral region BB of the display panel 001. The reference sense signal line 12 at the left side is coupled to the four source drivers 100*a* (the analog-to-digital conversion sub-circuits 101 in the four source drivers 100*a*) that are coupled to the PCB on the left, and the reference sense signal line 12 at the right side is coupled to the four source drivers 100*a* (the analog-to-digital conversion sub-circuits 101 in the four source drivers 100*a*) that are coupled to the PCB on the right.

The embodiments of the present disclosure further provide a control method of the display device. Referring to FIG. 1 and FIGS. 4A to 6, the control method includes a sense phase and a display phase.

It will be noted that, the control method is performed during a process of the display device displaying images. In some embodiments, the display process of the display device includes a plurality of frame periods. In each frame period, the actual values of the compensation parameters of the driving transistors in the selected sub-pixels in a row are sensed, and in a next frame period, the compensation parameters of the driving transistors in the selected sub-pixels in the row are compensated.

In the sense phase:

the pixel driving circuit 01 in the at least one selected sub-pixel P1 is turned on. For example, in a case where the plurality of sub-pixels P included in the display panel 001 are the selected sub-pixels P1, during the display process of the display device, in the sense phase, the sub-pixels in a row are selected for driving, so as to sense the actual values of the compensation parameters of the driving transistors DTFT of the pixel driving circuits 01 in the sub-pixels P in the row. The following description is made by taking one selected sub-pixel as an example. Therefore, in the following description, the number of each device and the number of each signal line are defaulted to one, respectively. The sense and compensation process of any selected sub-pixel in the sub-pixels in a selected row may be referred to the following description, which will not be repeated here.

The sense signal line 11 obtains the sense voltage signal of the driving transistor DTFT of the pixel driving circuit 01. The sense voltage signal is able to represent the actual value of the compensation parameter of the driving transistor DTFT. That is, the sense voltage signal and the actual value of the compensation parameter have a mapping relationship therebetween.

The two input terminals of the analog-to-digital conversion sub-circuit 101 in the source driving circuit 100 receive the sense voltage signal from the sense signal line 11 and the reference voltage signal from the reference sense signal line 12, respectively, and the analog-to-digital conversion sub-circuit 101 obtains the sensing digital signal in accordance with the voltage difference between the signals received at the two input terminals, and outputs the sensing digital signal to the timing control circuit 300. The sensing digital signal is able to represent the actual value of the compensation parameter of the driving transistor DTFT in the selected sub-pixel.

It will be noted that, the reference voltage signal is always input to the reference sense signal line 12.

It can be understood here that, theoretically, voltages of the two signals output to the two input terminals of the analog-to-digital conversion sub-circuit 101 through the sense signal line 11 and the reference sense signal line 12 are a sense voltage and a reference voltage. However, the voltages of the two signals actually output to the two input terminals of the analog-to-digital conversion sub-circuit 101 are affected by the parasitic effect of the capacitance inside the display panel and the noise of the circuit system, and have certain deviations from the sense voltage and the reference voltage. Since the at least one sense signal line 11 and the at least one reference sense signal line 12 are arranged in parallel in the display panel 001, the two are substantially uniformly affected by the parasitic effect of the capacitance inside the display panel 001 and the noise of the circuit system. In this way, when the analog-to-digital conversion sub-circuit 101 obtains the sensing digital signal in accordance with the voltage difference between the signals received at the two input terminals, the common mode noise is able to be eliminated. That is, the accuracy of the obtained sensing digital signal is ensured.

For example, referring to FIG. 4A, in the sense phase, turn-on signals are input to the first scanning terminal Scan1 and the second scanning terminal Scan2, and a reset signal is input to the sense signal line 11. For example, the turn-on signals are input to the first scanning terminal Scan1 and the second scanning terminal Scan2 through two adjacent gate lines. Or, the turn-on signals are input to the first scanning terminal Scan1 and the second scanning terminal Scan2 through a same gate line GL. The sense transistor T1 and the switching transistor T2 are turned on, and the switching transistor T2 writes a constant data voltage Vdata from the data line DL into the control electrode G of the driving transistor DTFT, and the sense transistor T1 writes a reset voltage Vref (a voltage of the reset signal) from the sense signal line 11 into the second electrode of the driving transistor DTFT. Vdata is greater than Vref. On this basis, the driving transistor DTFT generates the driving current. At this time, stop inputting the reset signal to the sense signal line 11, the sense transistor T1 is still turned on, and transmits the driving current to the sense signal line 11, so as to charge the sense signal line 11. In practice, a constant charging period may be given. In a case where the pixel driving circuit 01 further includes the sensing capacitor Csense, the sense transistor T1 transmits the driving current to the first electrode of the sensing capacitor Csense, so as to charge the sensing capacitor Csense and obtain the sense voltage signal.

After the charging is finished, turn-off signals (i.e., inverting signals of the turn-on signals) are input to the first scanning terminal Scan1 and the second scanning terminal Scan2, and the sense transistor T1 and the switching transistor T2 are turned off. For example, in a case where the turn-on signal is a high level signal, the turn-off signal is a low level signal. In this case, the first switch SMP is controlled to be turned on, so that the sense voltage signal from the sense signal line 11 and the reference voltage signal from the reference sense signal line 12 are respectively transmitted to the first input terminal and the second input terminal of the differential analog-to-digital converter (ADC). The differential analog-to-digital converter (ADC) obtains the sensing digital signal in accordance with the voltage difference between the signals received at the first input terminal and the second input terminal, and outputs the sensing digital signal to the timing control circuit (TCON).

In some embodiments, the reference voltage signal input from the reference sense signal line 12 may be the same as the reset voltage signal.

In the display phase:

the timing control circuit 300 receives the sensing digital signal from the source driving circuit 100, and obtains the compensation pixel data of the selected sub-pixel P1 in accordance with the sensing digital signal and the initial pixel data of the selected sub-pixel P1, so that the selected sub-pixel compensates for the compensation parameter of the driving transistor in the selected sub-pixel while being displayed in accordance with the compensation pixel data.

For example, the timing control circuit (TCON) receives the initial pixel data and timing control (TC) signals input from the outside of the display device, and at the same time, obtains a compensation amount of the compensation parameter of the driving transistor in a corresponding selected sub-pixel through calculation, conversion and compensation, in accordance with the sensing digital signal input from the source driving circuit 100, and generates the compensation pixel data of the selected sub-pixel in accordance with the compensation amount and the initial pixel data.

Next, the timing control circuit 300 outputs the compensation pixel data to the source driving circuit 100. At the same time, the timing control circuit 300 generates a source control signal and a gate control signal, and outputs the source control signal and the gate control signal to the source driving circuit 100 and the gate driving circuit 200, respectively.

The date driving circuit 200 receives the gate control signal to generate a date signal, and outputs the gate signal to the scanning terminal (e.g., Scan1 or Scan2) of the pixel driving circuit 01 in each sub-pixel through the gate line GL, so as to turn on the pixel driving circuit 01s in the sub-pixels row by row. The source driving circuit 100 receives the source control signal. When the pixel driving circuits 01 in the sub-pixels in a row (the sub-pixels in the row are the sub-pixels in a row that are selected in the sense phase) are turned on, the source driving circuit 100 generates a corresponding compensation pixel voltage in accordance with the received compensation pixel data, and outputs the compensation pixel voltage to each pixel driving circuit 01 that is turned on in the sub-pixels in the row through the data line DL, so that the display panel 001 compensates for the compensation parameter (including the threshold voltage and the mobility) of the driving transistor DTFT of each pixel driving circuit 01 in the sub-pixels in the row while achieving display.

The above only introduces a case that the sub-pixels in a row of the plurality of sub-pixels P are compensated. In some embodiments, the display device includes a plurality of sense phases and a plurality of display phases during the display process, so as to compensate for the sub-pixels in other rows. In this way, the compensation parameters of the driving transistors of the pixel driving circuits 100 in the sub-pixels may be compensated, and thus the compensation parameters of the driving transistors DTFT do not affect the uniformity and the stability of the light-emitting luminances of the light-emitting devices in the sub-pixels in the display panel.

A person of ordinary skill in the art will understand that, all or part of the steps in the above method embodiments may be implemented by using hardwares related to program instructions. The program instructions may be stored in a computer-readable storage medium for executing the steps included in the above method embodiments. The storage medium includes various media capable of storing program codes, such as a read-only memory (ROM), a random-access memory (RAM), a magnetic disk, or an optical disk.

The forgoing descriptions are merely specific implementations of the present disclosure, but the protection scope of the present disclosure is not limited thereto. Changes or replacements any person skilled in the art could conceive of within the technical scope of the present disclosure shall be included in the protection scope of the present disclosure. Therefore, the protection scope of the present disclosure shall be subject to the protection scope of the claims.

What is claimed is:

1. A display module, comprising:

a display panel including:

a plurality of sub-pixels, each sub-pixel including a pixel driving circuit, and the pixel driving circuit including a driving transistor; at least one of the plurality of sub-pixels being at least one selected sub-pixel, a pixel driving circuit in a selected sub-pixel in the at least one selected sub-pixel further including a sense transistor, and the sense transistor in the selected sub-pixel being coupled to the driving transistor in the selected sub-pixel;

at least one sense signal line, the sense transistor in the selected sub-pixel being coupled to a sense signal line in the at least one sense signal line, and the sense signal line being configured to obtain a sense voltage signal of the driving transistor in the selected sub-pixel through the sense transistor; and at least one reference sense signal line, a reference sense signal line in the at least one reference sense signal line being configured to transmit a reference voltage signal;

wherein the at least one reference sense signal line and the at least one sense signal line are arranged in parallel;

a source driving circuit including at least one analog-to-digital conversion sub-circuit; two input terminals of an analog-to-digital conversion sub-circuit in the at least one analog-to-digital conversion sub-circuit being coupled to at least one sense signal line and one reference sense signal line, respectively; the analog-to-digital conversion sub-circuit being configured to receive the sense voltage signal from the sense signal line and the reference voltage signal from the reference sense signal line, to obtain a sensing digital signal in accordance with a voltage difference between the sense voltage signal and the reference voltage signal received at the two input terminals, and to output the sensing digital signal; wherein the sensing digital signal is capable of representing an actual value of a compensation parameter of the driving transistor in the selected sub-pixel; and a timing control circuit coupled to an output terminal of the analog-to-digital conversion sub-circuit, and configured to receive the sensing digital signal from the source driving circuit, and to obtain compensation pixel data of the selected sub-pixel in accordance with the sensing digital signal and initial pixel data of the selected sub-pixel, so that the selected sub-pixel compensates for the compensation parameter of the driving transistor in the selected sub-pixel while being displayed in accordance with the compensation pixel data;

wherein the analog-to-digital conversion sub-circuit includes a differential analog-to-digital converter, a first switch and a noise reduction capacitor, wherein the differential analog-to-digital converter includes a first input terminal, a second input terminal and an output terminal;

the first input terminal of the differential analog-to-digital converter is coupled to at least one sense signal line through the first switch, the second input terminal of the differential analog-to-digital converter is coupled to one reference sense signal line, and the output terminal of the differential analog-to-digital converter is coupled to the timing control circuit;

a first electrode of the noise reduction capacitor is coupled to the first input terminal of the differential analog-to-digital converter, and a second electrode of the noise reduction capacitor is coupled to a ground terminal.

2. The display module according to claim 1, wherein an extending direction of the at least one reference sense signal line is a first direction;

the at least one reference sense signal line is disposed at at least one side of an active area of the display panel in a direction perpendicular to the first direction.

3. The display module according to claim 2, wherein the display panel includes one reference sense signal line;

the reference sense signal line is located at any side of the active area of the display panel in the direction perpendicular to the first direction;

the at least one analog-to-digital conversion sub-circuit is coupled to the reference sense signal line;

or, the display panel includes two reference sense signal lines;

the two reference sense signal lines are located at two sides of the active area of the display panel in the direction perpendicular to the first direction;

the source driving circuit includes at least two analog-to-digital conversion sub-circuits, some of the at least two analog-to-digital conversion sub-circuits are coupled to one reference sense signal line, and others of the at least two analog-to-digital conversion sub-circuits are coupled to another reference sense signal line.

4. The display module according to claim 1, wherein the display panel further includes a plurality of data lines, and each data line is coupled to pixel driving circuits in some of the plurality of sub-pixels; and all sub-pixels included in the display panel are selected sub-pixels, and pixel driving circuits coupled to a same data line are coupled to a same sense signal line.

5. The display module according to claim 1, wherein the display panel further includes a plurality of data lines, and each data line is coupled to pixel driving circuits in some of the plurality of sub-pixels; and all sub-pixels included in the display panel are selected sub-pixels, and pixel driving circuits coupled to a plurality of adjacent data lines that are arranged in sequence are coupled to a same sense signal line.

6. The display module according to claim 1, wherein the display panel includes at least two sense signal lines and the source driving circuit includes at least two analog-to-digital conversion sub-circuits, and different analog-to-digital conversion sub-circuits are coupled to different sense signal lines.

7. The display module according to claim 6, wherein one analog-to-digital conversion sub-circuit is coupled to at least two sense signal lines.

8. The display module according to claim 1, wherein the display panel further includes a plurality of gate lines;

in the pixel driving circuit in each selected sub-pixel, a control electrode of the sense transistor is coupled to one gate line, a first electrode of the sense transistor is coupled to a second electrode of the driving transistor, and a second electrode of the sense transistor is coupled to one sense signal line.

9. The display module according to claim 8, wherein the pixel driving circuit in the selected sub-pixel further includes a sensing capacitor;

a first electrode of the sensing capacitor is coupled to one sense signal line, and a second electrode of the sensing capacitor is coupled to a ground terminal.

10. The display module according to claim 8, wherein the pixel driving circuit in each sub-pixel further includes a switching transistor and a storage capacitor;

a control electrode of the switching transistor is coupled to one gate line, a first electrode of the switching transistor is coupled to one data line, and a second electrode of the switching transistor is coupled to a control electrode of the driving transistor;

a first electrode of the storage capacitor is coupled to the control electrode of the driving transistor, and a second electrode of the storage capacitor is coupled to the second electrode of the driving transistor;

a first electrode of the driving transistor is coupled to a first power supply voltage terminal, the second electrode of the driving transistor is further coupled to a first electrode of a light-emitting device, and a second electrode of the light-emitting device is coupled to a second power voltage terminal.

11. The display module according to claim 10, wherein the light-emitting device is an organic light-emitting diode.

12. A display device, comprising the display module according to claim 1.

13. A control method of the display device according to claim 12, comprising:

in a sense phase:

in at least one selected sub-pixel, the pixel driving circuit being turned on, and the sense signal line obtaining the sense voltage signal of the driving transistor of the pixel driving circuit; the sense voltage signal being capable of representing the actual value of the compensation parameter of the driving transistor;

the two input terminals of the analog-to-digital conversion sub-circuit in the source driving circuit receiving the sense voltage signal from the sense signal line and the reference voltage signal from the reference sense signal line, respectively, and the analog-to-digital conversion sub-circuit obtaining the sensing digital signal in accordance with the voltage difference between the sense voltage signal and the reference voltage signal received at the two input terminals, and outputting the sensing digital signal to the timing control circuit; the sensing digital signal being capable of representing the actual value of the compensation parameter of the driving transistor in the selected sub-pixel; and in a display phase:

the timing control circuit receiving the sensing digital signal from the source driving circuit, obtaining the compensation pixel data of the selected sub-pixel in accordance with the sensing digital signal and the initial pixel data of the selected sub-pixel, so that the selected sub-pixel compensates for the compensation parameter of the driving transistor in the selected sub-pixel while being displayed in accordance with the compensation pixel data.

14. The control method of the display device according to claim 13, wherein the timing control circuit receiving the sensing digital signal from the source driving circuit, and obtaining the compensation pixel data of the selected sub-pixel in accordance with the sensing digital signal and the initial pixel data of the selected sub-pixel, includes:

the timing control circuit obtaining a compensation amount of the compensation parameter of the driving transistor in a corresponding selected sub-pixel through calculation, conversion, and compensation, in accordance with the sensing digital signal and the initial pixel data of the corresponding selected sub-pixel, and generating the compensation pixel data of the corresponding selected sub-pixel in accordance with the compensation amount and the initial pixel data.

* * * * *